US007654046B2

(12) United States Patent
Ellingson

(10) Patent No.: US 7,654,046 B2
(45) Date of Patent: Feb. 2, 2010

(54) DOOR FRAME WITH UNITARY HEAD FLASHING, NAILING FIN, AND TEAR-AWAY CONSTRUCTION COVER

(75) Inventor: Robert T. Ellingson, Social Circle, GA (US)

(73) Assignee: Reese Enterprises, Inc., Covington, GA (US)

( * ) Notice: Subject to any disclaimer, the term of this patent is extended or adjusted under 35 U.S.C. 154(b) by 761 days.

(21) Appl. No.: 10/803,005

(22) Filed: Mar. 17, 2004

(65) Prior Publication Data

US 2005/0204657 A1 Sep. 22, 2005

(51) Int. Cl.
*E04B 1/04* (2006.01)

(52) U.S. Cl. ..... 52/212; 52/61; 52/98; 52/463

(58) Field of Classification Search ..... 52/211, 52/212, 463, 58, 98, 100, 204.1, 208, 210, 52/213, 105, 62, 60, 61, 99, 204.55, 214, 52/204.56; 428/156, 43; 49/504
See application file for complete search history.

(56) References Cited

U.S. PATENT DOCUMENTS

| | | | | |
|---|---|---|---|---|
| 5,119,609 | A | 6/1992 | Tait et al. | |
| 5,203,130 | A * | 4/1993 | Freelove | 52/211 |
| 5,588,266 | A | 12/1996 | Headrick | |
| 5,611,173 | A | 3/1997 | Headrick et al. | |
| 5,775,045 | A * | 7/1998 | Hill | 52/211 |
| 6,125,605 | A * | 10/2000 | Young | 52/717.01 |
| 7,111,433 | B2 * | 9/2006 | Kerscher | 52/212 |
| 7,204,059 | B2 * | 4/2007 | Schiffmann et al. | 52/211 |

* cited by examiner

*Primary Examiner*—Richard E Chilcot, Jr.
*Assistant Examiner*—William V Gilbert
(74) *Attorney, Agent, or Firm*—Womble Carlyle Sandridge & Rice PLLC

(57) ABSTRACT

A door assembly includes a frame with brick mold, a threshold, and a door panel. A plastic member is mounted to the frame and the plastic member defines a flashing strip, a nailing fin, and a tear-away construction cover that protects a portion of the frame, such as the brick mold, from damage during construction. After construction, the construction cover is torn away to reveal the protected clean and undamaged brick mold.

12 Claims, 4 Drawing Sheets

DOOR FRAME WITH UNITARY HEAD FLASHING, NAILING FIN, AND TEAR-AWAY CONSTRUCTION COVER

TECHNICAL FIELD

This invention relates generally to entryway systems and more specifically to nailing fins, head flashing, and construction covers for entryway systems.

BACKGROUND

The door frame of a traditional pre-hung entryway system typically includes a threshold or sill, a pair of vertical jambs projecting upwardly from the ends of the sill, and a horizontal head jamb or header spanning the top ends of the vertical jambs. Brick mold usually extends around the outer edges of the jambs and header and frames the outside periphery of the entryway. In some cases, the brick mold is made of traditional milled wood. However, extruded plastic or extruded composite brick mold and other jamb components have become more prevalent in recent years. The prior art includes, for example, a combination wood and extruded plastic jamb as disclosed in my U.S. Pat. No. 6,148,582 and an all-extruded plastic composite jamb as disclosed in my U.S. patent application Ser. No. 10/273,009.

Particularly prevalent in entryways having extruded plastic components, but also found in all-wood entryways, is a laterally projecting nailing fin that surrounds the frame of the entryway. During installation, the nailing fin is attached to the outside facade of a building surrounding the framed-in opening to secure the pre-hung entryway assembly in the opening. In many cases, the nailing fin is made of plastic, such as PVC, and is provided with pre-punched nailing holes along its length. Such nailing fins may be co-extruded with the plastic brick mold or may be separate components attached to the brick mold surrounding the door frame.

In traditional construction, it often has been common to flash the header of a door frame to prevent rainwater from seeping behind the frame and deteriorating underlying framing and siding. Flashing may be provided, for instance, by a strip of metal extending from behind the siding and over the top of the head jamb brick mold. In other cases, flashing may be provided by a wood or plastic drip edge applied to the top of the brick mold. In any case, the goal is to provide a barrier preventing water from seeping between the head jamb brick mold and the siding.

Another common problem in building construction is that entryways, which typically are installed prior to the end of construction, can easily become damaged as construction workers carry heavy materials and tools through the entryway. Recently, removable plastic construction covers have become common on thresholds and these covers protect the thresholds from damage during construction. However, protection of brick mold and jamb components has been meager at best, and sometime includes nothing more than a thin layer of removable tape, which provides little if any protection.

Problems with traditional nailing fins, header flashing, and construction covers are many. For example, these components, especially flashing and construction covers, have heretofore been separately installed, when installed at all, and such installation is time consuming and requires a measure of carpentry skill. Construction covers for jambs and headers have generally been ineffective and do not tend to provide much protection from damage.

Accordingly, a need exists for an entryway system that incorporates nailing fins, head flashing, and an effective easily removable construction cover to protect brick mold from construction damage. These elements should be an integral part of a pre-hung entryway system and should require no additional time or skill for their installation and use. It is to the provision of such an entryway system that the present invention is primarily directed.

SUMMARY OF THE INVENTION

Briefly described, the present invention, in one preferred embodiment thereof, comprises a frame for a window or door. The frame has side jambs, a head jamb, and a decorative brick mold that extends around the perimeter of the frame along the outside edge portions of the jambs. An extruded plastic member is mounted to at least the head jamb and extends along the length thereof. The plastic member is profiled to define a flashing strip that overlies and covers the top of the brick mold along the head jamb. A downwardly projecting barbed tab extends along the bottom of the flashing strip and fits into a corresponding groove in the top of the brick mold to fasten the plastic member securely to the brick mold.

A downturned drip edge extends along the outside edge of the flashing strip and the drip edge covers the upper outside corner portion of the brick mold. A plastic construction cover is attached to the drip edge by means of a co-extruded tear-away connection and the construction cover projects downwardly to cover the outside face of the brick mold. Thus, the construction cover protects the brick mold during construction of a building in which the frame is installed. When construction is complete, the construction cover is torn away along the tear-away connection and discarded, revealing the clean protected brick mold beneath. The tearing away of the construction cover leaves the drip edge in tact, which thereafter functions to divert water away from the frame to prevent leakage and consequent damage.

The extruded plastic member also is formed with an integral nailing fin that is attached to the flashing strip along its inside edge. The nailing fin may be attached to the flashing strip by means of a co-extruded flexible hinge so that the nailing fin can lie flat for storage and shipment and be erected and secured to framing members for mounting the frame in a roughed-in opening. Alternatively, the nailing fin can itself be extruded entirely of a flexible material.

The side jambs of the frame also may be provided with a construction cover attachment similar to that of the head jamb described above. In the case of side jambs, however, it likely is not desirable to provide a drip edge that overlies the outside corners of the brick mold because such a drip edge at this location is not particularly functional and may be considered unsightly. Therefore, the side jambs may be provided with an attached extruded plastic member having a flashing strip without a drip edge. The construction cover is removably attached to the flashing strip at a location recessed from the outside edge of the brick mold. In this way, the construction cover overlies and protects the brick mold of the side jambs but, when torn away after construction, does not leave exposed a drip edge or other exposed part of the flashing strip.

Thus an improved frame for a window or door is now provided that offers distinct advantages over the prior art. Specifically, the frame includes unitary co-extruded plastic members mounted around the peripheral brick mold of the frame that simultaneously provide flashing strips, nail fins, and tear away disposable construction covers. The construction covers overlie and protect the faces of the brick mold during building construction. After construction, the construction covers are simply torn away and discarded, revealing the clean protected brick mold beneath and leaving a flashing strip and drip edge along the head jamb. These and other objects features and advantages of the invention will be more readily understood upon review of the detailed description set forth below taken in conjunction with the accompanying drawing figures, which are briefly described as follows.

DETAILED DESCRIPTION OF THE PREFERRED EMBODIMENTS

Figure 1:
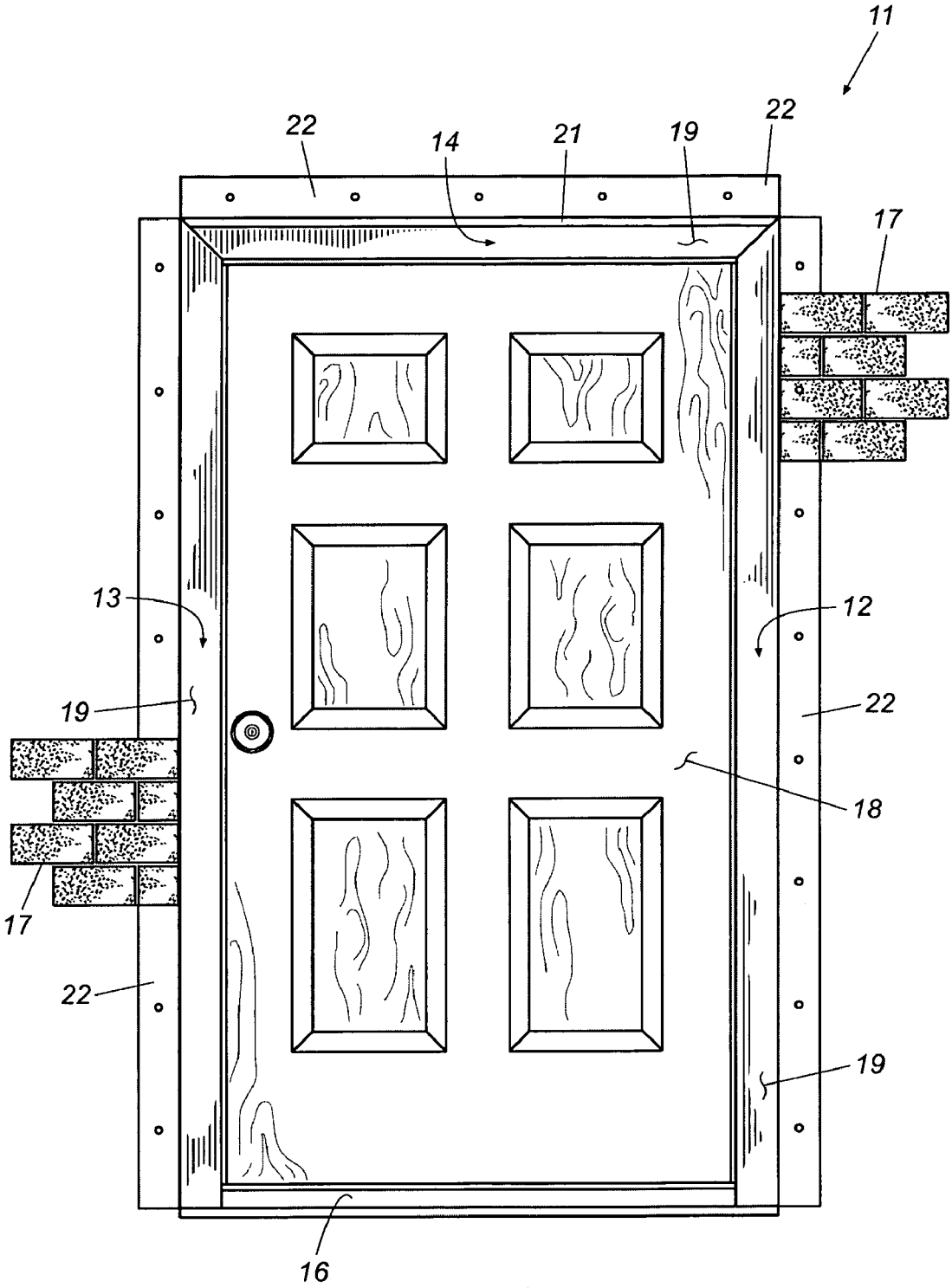
FIG. 1 is a front plan view of a pre-hung door assembly that embodies principles of the invention in a preferred form.

Referring now in more detail to the drawing figures, in which like reference numerals refer to like parts throughout the several views, FIG. 1 shows a typical pre-hung door assembly that embodies principles of the invention. It will be understood that the present invention also is applicable to windows and window frames as well, but door assemblies are illustrated and described herein because they represent a best mode of carrying out the invention. The door assembly 11 in FIG. 1 includes a frame comprised of two vertically extending side jambs 12 and 13, a head jamb 14, and a sill 16. A door panel 18 is hingedly mounted in the frame in the traditional way. The pre-hung door assembly is intended to be mounted within a roughed in opening within the wall of a building structure (a wall being indicated at 17). For this purpose, plastic nailing fins 22, which are more fully described below, project laterally from the periphery of the frame. During installation, the assembly is positioned within a roughed-in opening, plumed and leveled, and attached by driving nails through the nailing fins 22 an into the framing studs framing the roughed-in opening. The plastic nailing fins are part of a larger extruded plastic member that mounts to the brick mold of the frame and that also defines flashing strips, a drip edge, and tear-away construction covers according to the invention, all as described in more detailed below.

Figure 2:
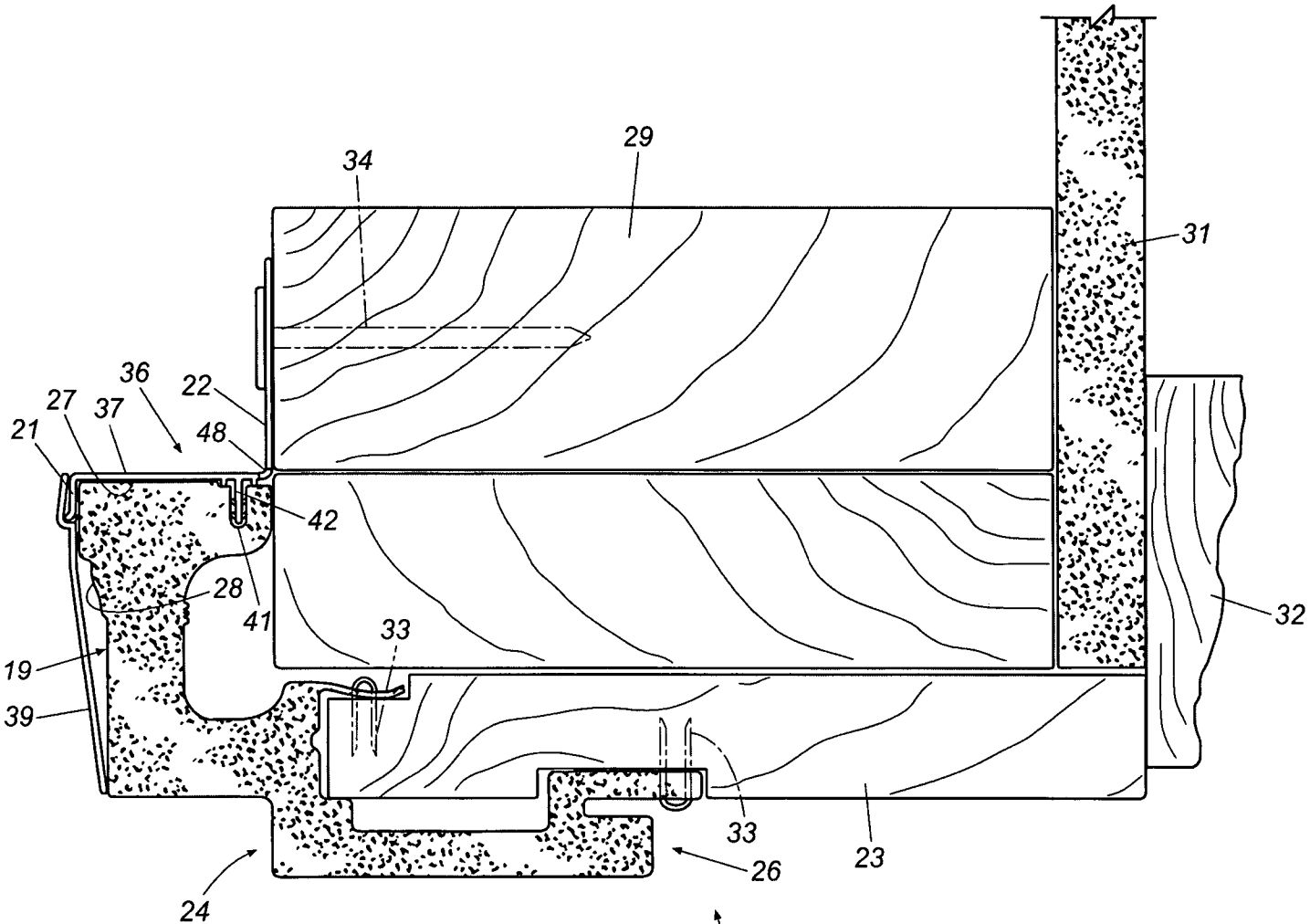
FIG. 2 is a cross sectional view of a head jamb assembly that embodies principles of the present invention in one preferred form.

FIG. 2 is a cross-sectional view of a head jamb assembly incorporating aspects of the present invention. In this example, the head jamb assembly is of the combination wood and extruded plastic type, such as that disclosed in the above referenced U.S. patent; however, an all-wooden jamb, an all plastic jamb, or a jamb of any combination of materials is considered to be within the scope of this invention. The head jamb assembly 14 is shown as it appears when mounted in a roughed-in opening in a building. The top of the opening is defined by framing members or header studs 29 and the inside of the building is shown finished with drywall 31 and door casing 32. The jamb assembly 14 itself comprises a wooden jamb board 23 to which is integrally attached an extruded plastic brick mold and stop member 24. The brick mold and stop member 24 in the illustrated embodiment is secured to the wooden jamb board by staples 33 and is configured to define a raised stop 26 and brick mold 19, which frames the outside perimeter of the door frame. The brick mold 19 has a top surface 36 and an outside face 28 and is profiled to mimic the decorative appearance of a traditional milled wooden brick mold. An elongated groove 41 is formed along the top surface 27 and extends the length of the brick mold.

A co-extruded plastic member 36, configured according to a preferred embodiment of the present invention, is securely mounted to the brick mold and also extends along the length thereof. The plastic member 36 is formed with a flashing strip 37 that overlies and covers the top surface 27 of the brick mold. A depending barbed tab, described in more detail below, is formed along the underside of the flashing strip and is positioned and sized to be received in the elongated groove 41 for securing the plastic member 37 firmly to the brick mold. A nailing fin 22 is attached along the inside edge of the flashing strip 37 by means of a co-extruded flexible hinge 48. The flexible hinge 48 allows the nailing fin 22 to be folded down for storage and shipment of the door assembly 11 and then folded up, as shown in FIG. 2, for installation. During installation, the nailing fin is attached to the framing members 29 of the roughed-in opening by nails 34 or other appropriate fasteners.

A depending drip edge 21 is formed along the outside edge of the flashing strip 37 and projects downwardly to cover the upper outside corner and a small area at the top of the front face 28 of the brick mold. The drip edge is formed with a lip 20 (FIG. 3), which is configured to cause water droplets to form and drop from the lip away from the door assembly during a rain. The co-extruded plastic member 36 is further formed with a plastic construction cover or flap 39 sized and configured to overlie and cover the front face 19 of the brick mold. The construction cover, which preferably is made of a relatively rigid plastic such as PVC of ABS, functions to protect the face of the brick mold during construction of a building in which the door assembly 11 is installed, a time, as mentioned above, during which tools and building materials carried through the door historically have resulted in damage to pre-installed door assemblies.

The construction cover 39 is attached to the bottom edge portion of the drip edge 21 by means of a tear-away connection 49 (FIG. 4), which is co-extruded with the plastic member. The tear-away connection 49 is made of a relatively soft plastic material and is profiled so that the construction cover can be torn away relatively easily from the drip edge along the tear-away connection. In use, the construction cover is left in place to protect the brick mold from damage until construction of a building is complete. Then, the construction cover can simply be torn away and discarded, revealing the clean, protected, and undamaged face of the brick mold beneath. The brick mold is thus protected during construction, eliminating substantial costs associated with repairs that sometimes have been required in the past.

Figure 3:
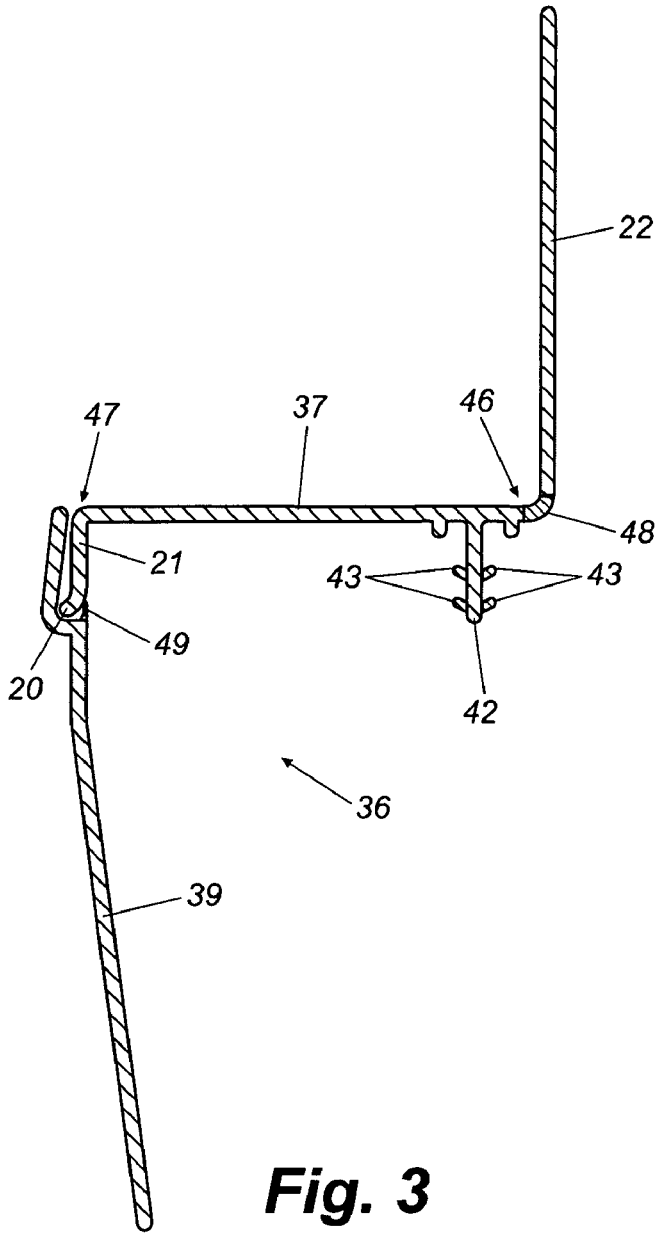
FIG. 3 is an enlarged cross-sectional view of an extruded plastic member for a head jamb that incorporates a flashing strip, drip edge, construction cover, and nailing fin according to principles of the invention.
Figure 4:
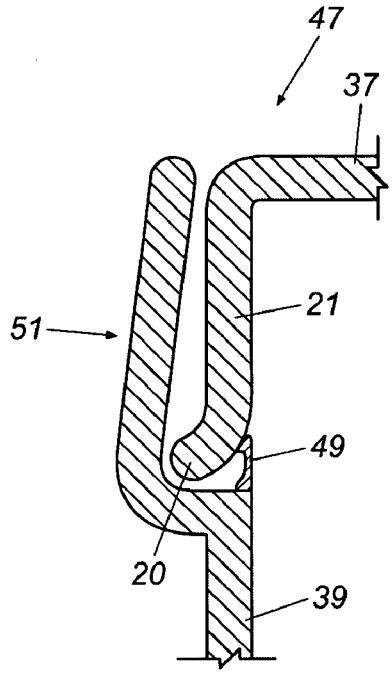
FIG. 4 is a close up cross-sectional view of a portion of the plastic member of FIG. 2 illustrating the co-extruded tear away attachment of the construction cover to the drip edge.

FIGS. 3 and 4 are enlarged views of the plastic member 36 illustrating details of its configuration. As described above, the plastic member 36 is co-extruded as a single unitary piece of plastics materials and has a flashing strip 37, a nailing fin 22 connected to the flashing strip by a flexible hinge 48, a drip edge 21, and a construction cover 39 attached with tear-away connection 49. The depending barbed tab 42 is shown in more detail in FIG. 3 and is seen to be formed with a main body and flexible barbs, which are made of a lower durometer plastic material, extending along opposed sides of the tab. The tab is sized to be pressed into the groove 41 (FIG. 2) along the top surface of the brick mold, whereupon the flexible barbs are deformed and bear against the walls of the groove to hold the plastic member securely to the brick mold.

FIG. 4 illustrates a preferred profile of the tear-away connection 49 by which the construction cover 39 is removably attached to the drip edge 21. The connection 49 is made of a relatively soft plastic material and is profiled with a thin central section that facilitates the relatively easy separation of the attachment along its length when the construction cover is torn away after construction. Further, the tear-away connection preferably is located along the inside portion of the drip edge as shown so that the remnants of the connection are hidden from view after the construction cover is torn away. As best seen in FIG. 4, the construction cover also is formed with an upper portion that forms a drip edge cover 51 for covering and protecting the drip edge 21 during building construction. The drip edge cover also helps hold the construction cover tightly against the outside face of the brick mold.

Figure 5:
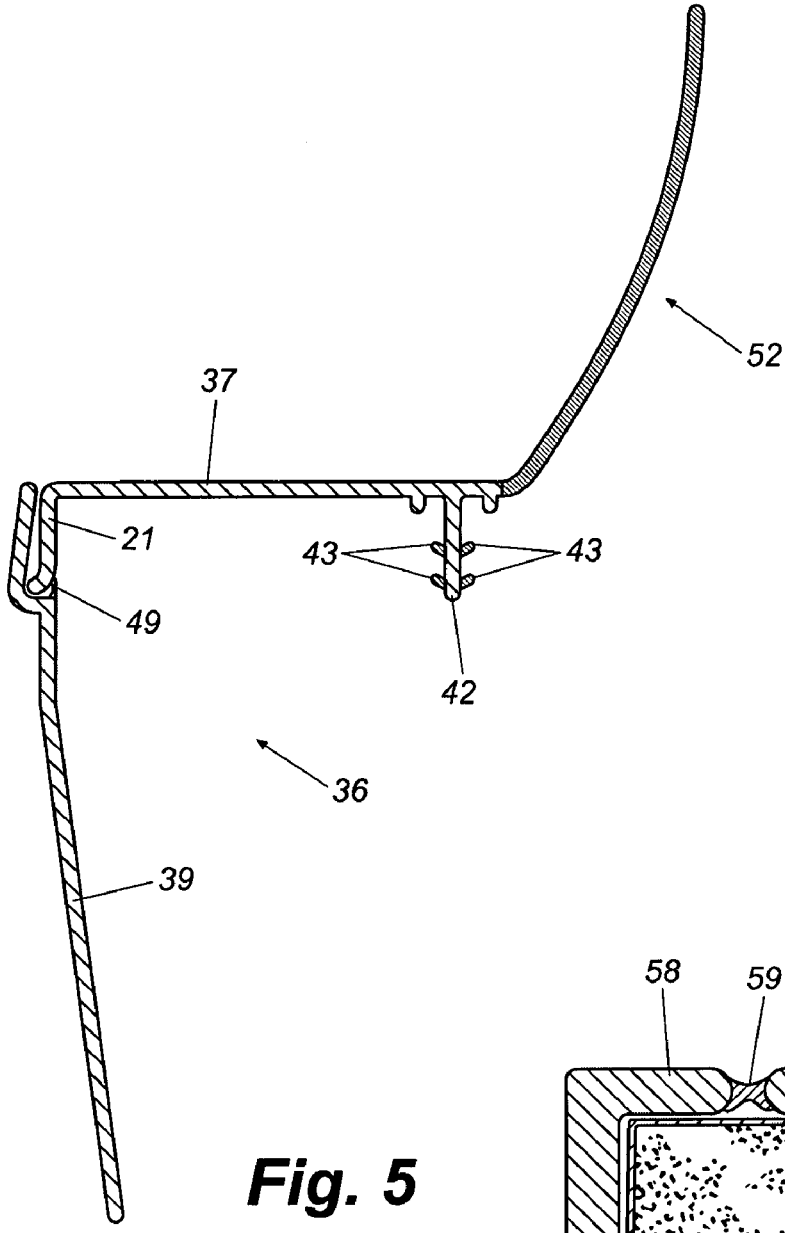
FIG. 5 is a cross-sectional view of a plastic member of an alternate embodiment wherein the nailing fin is extruded entirely of flexible plastic material.

FIG. 5 illustrates a possible alternate embodiment of the plastic member of the present invention. Here, the plastic member 36 also has a flashing strip 37, a drip edge 21, and a tear-away construction cover 39. In this embodiment, however, the entire nailing fin 52 is extruded of a lower durometer flexible plastic material rather than a more rigid plastic attached with a flexible hinge. Thus, the nailing fin still can be folded down for storage and shipment of a door assembly and folded up for attachment to the framing members of a roughed-in opening.

Figure 6:
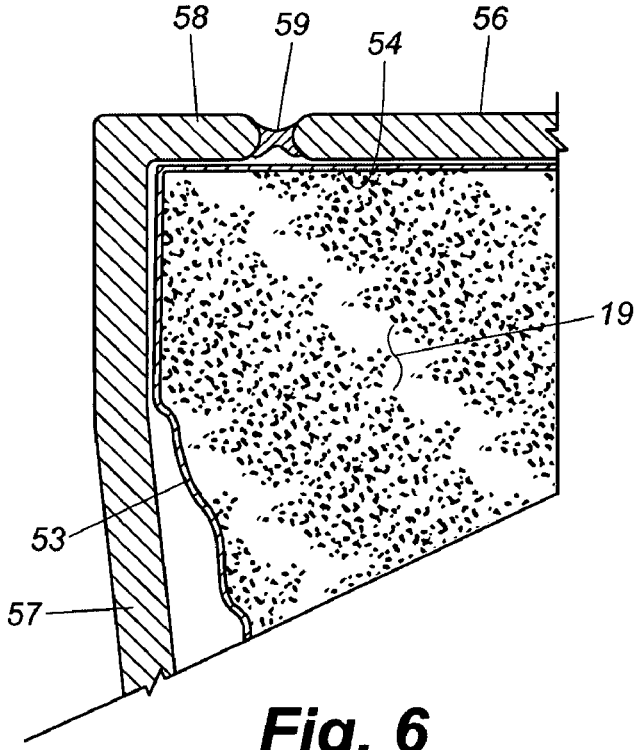
FIG. 6 is a close up cross sectional view of a side jamb showing a preferred tear-away attachment of a construction cover to the flashing strip along the side jamb.

FIG. 6 illustrates an embodiment of the present invention for providing a construction cover along the side jambs of a door assembly, where it may be undesirable to have a drip edge. Here, the plastic member is similar in other respects to that of FIGS. 2 and 5, but lacks the drip edge that overlaps onto the outside face of the brick mold 19. Instead, the flashing strip 56 terminates at a position recessed from the front face 53 of the brick mold. The construction cover 57 has an in-turned tang 58 along its edge and the tang is connected to the recessed edge of the flashing strip by means of a tear-away connection 59. Thus, protection of the brick mold along the vertical jambs is provided by the construction cover 57 but, when the construction cover is torn away, there is no drip edge left behind along the vertical jambs.

The plastic member of the present invention can be made of any appropriate combination of plastic materials as is known in the art of plastics extrusion. For instance, the more rigid portions of the member, such as the flashing strip, nailing fin, and construction cover, may be formed of PVC plastic while the flexible hinge and tear-away connection may be formed of a lower durometer and more flexible plastic. The present invention is not limited to any particular combination of plastic and all combinations known in the plastics extrusion art are explicitly included within the scope of the invention.

The invention has been described herein in terms of preferred embodiments and methodologies considered to represent the best mode of carrying out the invention. The illustrated embodiments, however, should not be considered to be limiting since numerous changes and additions may be made within the scope of the invention. For instance, the construction cover is shown in the illustrated embodiments covering and protecting the outside face of the brick mold. The cover can alternatively be configured to extend inwardly to cover a portion or the entirety of the brick mold and stop member 24 for protecting this entire component from damage. These and other additions, deletions, and modifications might well be made by those of skill in the art without departing from the spirit and scope of the invention as set forth in the claims.

What is claimed is:

1. A frame comprising:

a sill;

a pair of spaced side jambs extending upwardly from said sill;

a head jamb spanning said side jambs;

a unitary plastic flashing member attached to said head jamb, said plastic flashing member being configured to define a flashing strip overlying and covering an upwardly facing top surface of said head jamb to inhibit moisture contact with said head jamb, a tab projecting toward said head jamb, a nailing fin projecting upwardly from said flashing strip in a direction opposite said tab and away from said head jamb for use in attaching said frame to an adjacent structure with fasteners extending through said nailing fin, and a drip edge extending along an upper outside corner of said head jamb to direct water from said flashing strip away from said head jamb, and a temporary construction cover secured to said drip edge with a tear-away connection, said construction cover depending from said drip edge and being sized to overlie and protect said head jamb during construction and being torn away along said tear-away connection and discarded after construction to expose said head jamb.

2. The frame of claim 1 and wherein said nailing fin is attached to said flashing strip with a flexible hinge, said flexible hinge being formed of a different material than said nailing fin and said flashing strip.

3. The frame of claim 1 and wherein said drip edge includes a lip.

4. The frame of claim 1 and wherein said frame is a door frame.

5. The frame of claim 1 and wherein said side jambs and said head jamb include brick mold, said flashing strip covering an upwardly facing top surface of said brick mold.

6. A door assembly comprising a threshold, a pair of spaced vertical side jambs extending upwardly from said threshold to upper ends, a head jamb spanning said upper ends of said side jambs, brick mold extending along said vertical jambs and said head jamb, and a unitary plastic flashing member securely attached at least to said brick mold along said head jamb by a tab projecting from said plastic flashing member, said plastic flashing member defining both a permanently attached flashing strip overlying an upper top surface of said brick mold along said head jamb to inhibit moisture contact with said brick molds, a detachable construction cover secured to said flashing strip with a tear-away connection, and a nailing fin projecting in a direction opposite said tab, said construction cover depending from said flashing strip to overlie an outside face of said brick mold to protect said outside face from damage until said construction cover is torn away along said tear-away connection and discarded to expose the outside face.

7. A door assembly as claimed in claim 6 and further comprising a drip edge formed along said flashing strip.

8. A door assembly as claimed in claim 7 and wherein said construction cover is secured with a tear-away connection along said drip edge.

9. A door assembly as claimed in claim 6 and wherein said nailing fin projects outwardly from said flashing strip and away from said door assembly for fastening said door assembly to a surrounding structure with fasteners extending through said nailing fin.

10. A door assembly as claimed in claim 9 and wherein said nailing fin is attached to said flashing strip with a flexible hinge.

11. A door assembly as claimed in claim 6 and further comprising a second unitary plastic flashing member extending along each of said side jambs, said second plastic flashing member including a detachable construction cover overlying said brick mold along said side jambs.

12. A frame for a door or window, said frame comprising a sill, vertical side jambs, a head jamb, brick mold surrounding said frame along an outside edge of said jambs, and a plastic flashing member extending along at least said head jamb, said plastic flashing member having a permanently attached flashing strip that overlies an upper top surface of said brick mold to protect said brick mold from moisture, a tab extending from said flashing strip, a nailing fin extending from said flashing strip in a direction opposite said tab, and a detachable construction cover secured to and depending from said flashing strip and being sized to overlie and protect an otherwise exposed surface of said brick mold and that is detached from said flashing strip and discarded after construction leaving said flashing strip attached.

* * * * *